US006883775B2

(12) United States Patent
Coney et al.

(10) Patent No.: US 6,883,775 B2
(45) Date of Patent: Apr. 26, 2005

(54) PASSIVE VALVE ASSEMBLY

(75) Inventors: Michael Willboughby Essex Coney, Swindon (GB); Andrew Male, Crawley (GB); David Frankland West, Worthing (GB); Brian Charles Porter, Ferring (GB); Laurent Roger Spelliers, Chatswood (AU)

(73) Assignee: Innogy PLC, Swindon (GB)

( * ) Notice: Subject to any disclaimer, the term of this patent is extended or adjusted under 35 U.S.C. 154(b) by 0 days.

(21) Appl. No.: 10/240,401

(22) PCT Filed: Mar. 30, 2001

(86) PCT No.: PCT/GB01/01443

§ 371 (c)(1),
(2), (4) Date: Mar. 27, 2003

(87) PCT Pub. No.: WO01/75278

PCT Pub. Date: Oct. 11, 2001

(65) Prior Publication Data

US 2003/0168618 A1 Sep. 11, 2003

(30) Foreign Application Priority Data

Mar. 31, 2000 (GB) ..... 0007918

(51) Int. Cl.[7] ..... F16K 31/12
(52) U.S. Cl. ..... 251/48; 123/90.12
(58) Field of Search ..... 251/47, 48, 50, 251/62, 63.6, 63.5; 123/90.11, 90.12, 90.14, 90.49

(56) References Cited

U.S. PATENT DOCUMENTS

| | | | | |
|---|---|---|---|---|
| 1,486,567 A | | 3/1924 | Deacon | |
| 1,494,834 A | | 5/1924 | Hack | |
| 3,114,532 A | * | 12/1963 | Gray et al. | 251/30.01 |
| 5,259,345 A | * | 11/1993 | Richeson | 123/90.12 |
| 5,988,124 A | | 11/1999 | Duesmann | |

FOREIGN PATENT DOCUMENTS

| | | |
|---|---|---|
| DE | 1 042 607 B | 1/1956 |
| EP | 0 791 728 A1 | 8/1997 |
| GB | 2 102 065 A | 1/1983 |

* cited by examiner

*Primary Examiner*—Edward K. Look
*Assistant Examiner*—John K. Fristoe, Jr.
(74) *Attorney, Agent, or Firm*—Birch, Stewart, Kolasch & Birch, LLP

(57) ABSTRACT

A passive valve assembly for controlling the flow into or out of chamber (3) through a port (4). The valve assembly comprises a valve element (5) arranged to open in the direction of flow through the port. The valve element (5) has a piston (9) which is reciprocable in a cylinder (10) containing gas. On opening of the valve, gas is compressed in a first chamber (11) of the cylinder (10), and this energy of compression is used to reverse the direction of the valve element (5) and return it to its seat.

18 Claims, 3 Drawing Sheets

22
20
26
11
23
10
24
9
21
12
13
20
27
34
33
32
35
46
42
30
31
43
38
37
41
40
6
4
5
8
7

PASSIVE VALVE ASSEMBLY

This application is the national phase under 35 U.S.C. § 371 of PCT International Application No. PCT/GB01/01443 Which has an International filing date of Mar. 30, 2001, which designated the United States of America.

FIELD OF THE INVENTION

The present invention relates to a passive valve assembly for controlling flow into or out of a first cylinder in which a member, such as a piston, is reciprocable. Such a cylinder may be, for example, part of an internal combustion engine or a reciprocating air compressor.

BACKGROUND OF THE INVENTION

Valves for such applications can be broadly divided into two categories, namely active and passive. Active valves have an external means of actuation, while passive valves are activated only by pressure changes occurring during normal operation of the system.

Conventional diesel engines use active valve assemblies in which, typically, a cam and spring arrangement open and close poppet valves. This is a simple mechanical device which will always operate at the same point in the cycle for all engine speeds. In such active valve assemblies it is known, for example, from a U.S. Pat. No. 5,553,572 to replace a conventional mechanical spring with an air spring. This takes the form of the end of the poppet valve remote from the head having an air filled chamber. On opening the valve, the air is compressed by the cam shaft which opens the valve. This compressed air is then used to provide the closing force for the valve.

More recently, a drive towards optimising engines for different operating conditions has led to other types of active valve actuator, such as hydraulic, pneumatic and electromagnetic actuators, being considered. These allow the timing of the valve motion to be varied while the engine is running. The principle of compressing air which is used to do useful work is also used in pneumatically operated valves such as those disclosed in U.S. Pat. Nos. 5,022,359, 5,152,260, 5,259,345 and EP-A-0,554,923. In all of these cases pneumatic pressure is applied to one side of a piston forming part of the valve assembly. The piston then moves to open the valve assembly and compress air, the pressure of the compressed air being used to return the valve to its original position. The pressure within the assembly is controlled such that the valve element is held in certain positions in order to provide the necessary open time for the valve to satisfy the engine requirements. Control of the movement of the piston is achieved by selectively introducing high pressure air into the chambers on either side of the piston and/or venting air from these chambers. These devices consume a significant amount of compressed air which is vented out of the chambers, thereby wasting energy.

Passive valves such as plate valves are generally found in conventional or reciprocating air compressors. These operate passively in response to the changing pressure in the cylinder and close when the pressure drop due to the flow drops below a certain level. No external control, be it mechanical, hydraulic, pneumatic or electromagnetic is applied to influence the valve element during a single stroke.

Such active and passive valves are widely used with great success in many applications. However no prior art design has been found to be successful for an application such as reciprocating compression or expansion with a high pressure ratio, which requires the valve to be open for a relatively short duration and occupy a small volume of the cylinder without causing high pressure losses or high parasitic power consumption. A cycle having components which require such characteristics is that disclosed in WO 94/12785. This document discloses a combined reciprocating isothermal compression and internal combustion cycle. It has been found that the discharge valve on the compressor is required to be open for only about 40° of crank angle. This compares with a conventional diesel engine in which the discharge valve is open for about 150° of crank angle.

Conventional active actuators are not capable of operating valves at the size required for such an application and at the desired speed without having a high parasitic power consumption.

Conventional passive actuators are also unacceptable. Plate valves need to be large in diameter for a given flow. This is not a problem if the compression ratio is low as it is in a conventional reciprocating air compressor, since there is sufficient volume at the top of the cylinder when the valves are open. However, if a high compression ratio is sought then the volume available when the valves open is small.

SUMMARY OF THE INVENTION

According to the present invention there is provided a passive valve assembly for controlling flow into or out of a first cylinder in which a member is reciprocable, the assembly comprising a valve element having a head at one end which seats in a port in the first cylinder and is arranged to open in the direction of flow through the port and a piston which is reciprocable in a further cylinder, the side of the piston which faces in the direction of opening defining with the further cylinder a first chamber which is filled with gas such that upon opening of the valve element the gas is compressed in the first chamber, the energy of compression being recovered to close the valve element.

With this arrangement, when the pressure in the first cylinder causes the valve element to open, the piston compresses the gas in the first chamber increasing the pressure of gas to a level which immediately reverses the direction of force acting on the valve element, consequently stopping and then returning it to its seat. As almost all of the energy used to compress the gas in the first chamber when the valve moves away from its seat is recovered when the valve reverses its direction, parasitic losses are small. Once seated, the valve is held in the closed position by the pressure differential across the valve head.

The present invention also allows the use of poppet valves, thereby overcoming the above mentioned problems of excessive size and lack of control associated with plate valves.

Also, the closing point of the valve can be controlled by the engine control system, which is not possible using plate valve.

As the assembly is passive, the piston is not latched. Under some circumstances, the valve is in almost continuous motion from the time it leaves the seat until it re-seats. In this case there is a brief instant when the valve velocity reduces to zero as it reverses its direction at the full extent of its travel. However, there is a physical limit to the possible lift of the valve and under certain circumstances, the valve may be designed to reach an end stop, where there may be a finite pause before the valve starts to return to its seat. In this case the stop may be designed to absorb and dissipate energy in the manner of a damper. For example, the design of the end stop may involve the squeezing of a gas film between the piston and the end stop, in order to avoid a potentially damaging impact.

The design of the end stop may be chosen in order to optimise the dynamic response of the valve to the various pressures which might be applied to the valve head or the piston. In particular the end stop may be used to achieve longer durations of valve opening without having an excessively large valve travel.

The valve assembly may be used either as an inlet valve or an outlet valve. As an inlet valve, the direction of opening is towards the reciprocable member, while the first chamber is on the side of the piston closest to the valve head. On the other hand, for an outlet valve, the valve will open away from the reciprocable member, and the first chamber is on the side of the piston remote from the valve head. Such an outlet valve has been found to be particularly suitable as a compressor discharge valve for the reciprocating compressor of WO 94/12785.

The valve assembly is passive in the sense that no external influences control the motion of the valve element during a single cycle consisting of two strokes. In other words, the only factors affecting the movement of the valve element are the varying pressure across the valve head caused by movement of the reciprocable member and the varying pressure in the further cylinder caused by movement of the piston. However it is still possible to exert some control over the timing of the opening and closing of the valve element by varying the gas pressure in the first chamber over a number of cycles to accommodate various operating conditions. The pressure in the first chamber can further be controlled to allow for any leakage and for the effects of temperature change.

In order to provide a counter force to the force provided by the first chamber, the piston and further cylinder preferably define a second chamber on the opposite side of the piston to the first chamber, the second chamber being filled with gas, such that upon closing of the valve element the gas is compressed in the second chamber. The provision of the second chamber to provide a counter force enables the pressure to be increased in the first chamber, without creating a net force on the piston which is too large for the valve to be opened. This allows the size of the first chamber to be smaller than it would otherwise need to be without the second chamber. The counter-balancing force of the second chamber is also important when the valve closes, since much of the kinetic energy of the valve can be re-absorbed ready for the next cycle, instead of being dissipated by damping.

In certain circumstances, for example in the case of a discharge valve of a compressor with a high pressure ratio, there is little time available for the valve to open and shut. In this case, the valve assembly is preferably arranged such that the net force on the piston caused by the gas in the first and second chambers is such that, when the valve is seated, the piston is biased in a direction to open the valve. With this arrangement the valve can be opened while the pressure in the first cylinder is less than the pressure on the other side of the valve head. This is important in applications where the open time of the valve is very short. Although it will result in a small amount of reverse flow around the valve head, this will be insignificant, and will be more than compensated for by the advantages obtained from opening the valve at the correct time. This forms a second aspect of the invention as described below.

If the second chamber is too small, it is possible that the gas will be compressed to such an extent that it will prevent the valve from closing. In order to avoid this, the second chamber could be lengthened, thereby reducing the compression ratio. However, this will increase the overall length of the valve. Preferably, therefore, the second chamber is in fluid communication with an auxiliary chamber, the second chamber and auxiliary chamber providing a closed volume. The effect of this is that, as the valve closes, the air in the second and auxiliary chambers will be compressed, but not to the same degree as it would have been without the auxiliary chamber. Further, the pressure in the second and auxiliary chambers will be greater than the pressure in the first chamber when the valve is closed thus tending to bias the valve open.

When the valve element returns to its seat, the gas in the second chamber will be compressed thereby slowing the motion of the valve element. It is preferable for this motion to be carefully regulated such that the valve quickly approaches its seat but does not collide with it. In order to improve this motion a damping mechanism is preferably provided to dampen the motion of the valve toward its seat.

One possible damping mechanism is a disk provided on the valve element separate from the piston and having a smaller diameter than that of the piston, and a complimentary counterbore in the wall of the second chamber, such that the disk reciprocates within the counterbore for a part of the stroke.

Alternatively, a disk could be provided on the valve element so as to be reciprocable in a damping chamber which is separate from the second chamber, the damping chamber being filled with a gas or liquid. The diameter of the damping chamber is preferably significantly larger than the diameter of the disk for the majority of the stroke of the disk, but approaches the diameter of the disk for the proportion of the stroke approaching the closed position of the valve. This allows the damping effect of the damping chamber to be negligible during opening of the valve and during the majority of the closing, but to come into effect only when the valve approaches its closed position. At this time, a small volume of gas or liquid is essentially trapped in the small diameter portion of the damping chamber thereby rapidly producing a high degree of damping as the gas or liquid squeezes at high velocity through a gap between the disk and the damping chamber. The damping force is dependent on velocity so will be significant as the valve closes at high velocity, but will be negligible when the valve opens again at low velocity.

The disk is preferably inwardly tapered in the direction in which the valve moves on closing as this provides a gradual decrease of the area between the periphery of the disk and the wall of the small diameter portion of the damping chamber. This is important because the velocity of the valve will be high at the start of the damping and will reduce during the damping process. The tapering disk provides a relatively constant damping force during the entire damping process, such that the peak damping force can be significantly reduced. This allows the size of the components to be minimised providing a lower mass, and hence an improved dynamic performance.

An alternative damping mechanism is a squeezed film damper mechanism comprising a surface which is movable with the piston and which approaches a mating surface which is stationary with respect to the piston such that a thin film of gas is squeezed between the two surfaces at high velocity out of a gap between the two surfaces as the valve head approaches its seat. This damping arrangement is particularly effective at high gas pressure as the degree of damping is proportional to the pressure of the gas between the two surfaces. The advantage of a squeeze film damper mechanism is that it can be conveniently used with a compressible gas, since the volume of gas trapped within the film is very small relative to the area of the two mating surfaces. If a compressible gas can be used, then it is possible to put the damping assembly inside the second chamber. This avoids the need for a separate oil-filled chamber with associated sealing and draining.

A second aspect of the present invention which may be used either together with or independently of the first aspect is provided by a passive valve assembly for controlling flow into or out of a first cylinder in which a member is reciprocable, the assembly comprising valve element having a head at one end which seats in a port in the first cylinder and is arranged to open in the direction of flow through the port, the valve element being biased such that when it is seated, and disregarding any forces acting on the head, the valve is biased open.

With this arrangement the valve can be opened while the pressure in the first cylinder is less than the pressure on the other side of the valve head. This is important in applications where the open time of the valve is very short. Although it will result in a small amount of reverse flow around the valve head, this will be insignificant, and will be more than compensated for by the advantages obtained from opening the valve at the correct time.

The biasing force may be provided by any well known means, for example a resilient member such as a mechanical spring. However, preferably, the valve element is provided with a piston, and the biasing force is provided by pressurised gas acting on at least one side of the piston. This arrangement using pressurised gas is better suited to the pressures associated with a valve of a reciprocating compressor, and also allows ready adjustment of the operating point of the valve by varying the pressure of the gas.

The valve may be biased open by a single biasing force. However, a more balanced biasing force can be provided by two opposing biasing forces acting on the valve element, a first force tending to bias the valve open being greater than a second force tending to bias the valve closed when the valve is seated.

BREIF DESCRIPTION OF THE DRAWINGS

An example of a valve assembly constructed in accordance with the present invention will now be described with reference to the accompanying drawings, in which.

DETAILED DESCRIPTION OF THE EMBODIMENTS

The valve to be illustrated and described is particularly applicable as the discharge valve for a reciprocating compressor such as that disclosed in WO 94/12785.

Figure 1:
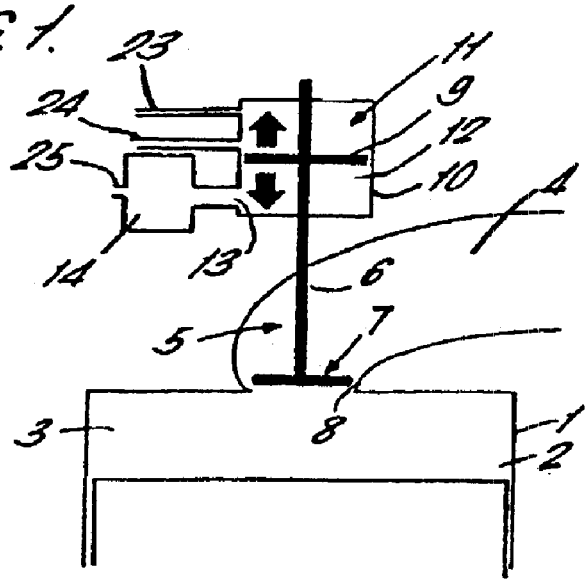
FIG. 1 is a schematic diagram showing the basic elements of the invention.
Figure 2:
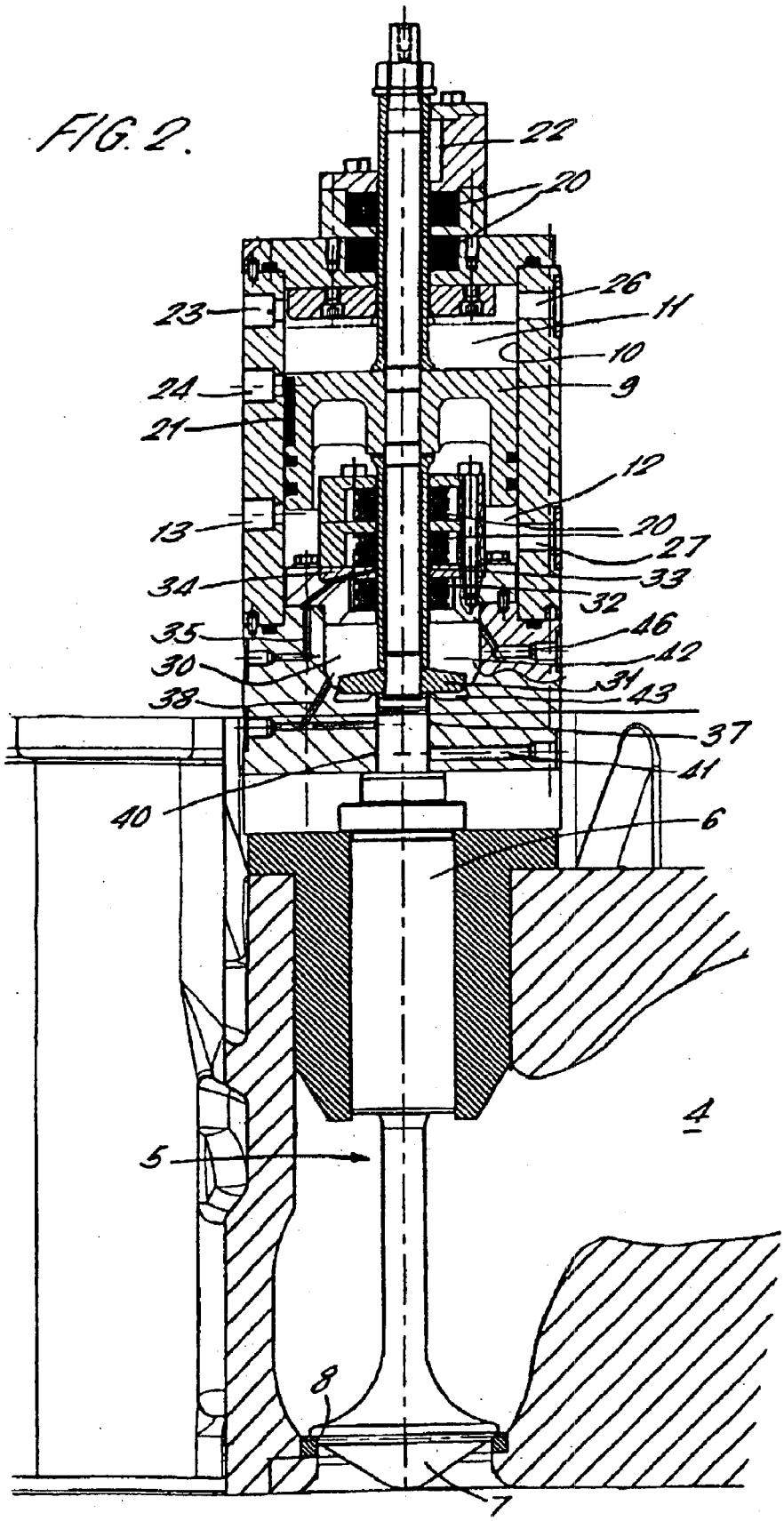
FIG. 2 is a cross-section showing the details of construction of the valve assembly with a first guide system being shown to the left of the centre line and a second guide system shown to the right of the centre line.

The reciprocating compressor comprises a first cylinder 1 in which a member 2 is reciprocable to compress gas in a compression chamber 3 above the reciprocating member 2. Gas to be compressed enters the compression chamber 3 through an inlet port (not shown) controlled by an inlet valve (not shown) and the compressed gas leaves the chamber through discharge port 4 controlled by discharge valve element 5 which opens away from the compressor chamber 3, namely upwardly as shown in FIGS. 1 and 2.

The discharge valve element 5 is a poppet valve comprising a valve stem 6 having a head 7 at one end which seats in a seat 8 in the first cylinder 1. At the opposite end of the valve stem 6 to the head 7 is a piston 9 which is reciprocably movable within a cylinder 10. The piston 9 divides the cylinder 10 into a first chamber 11 and a second chamber 12. The first chamber 11 is closed in the sense that there is substantially no flow into and out of this chamber during a single stroke of the piston 9. The second chamber 12 is connected by a large port 13 to an auxiliary chamber 14. The second chamber 12, large port 13 and auxiliary chamber 14 form a closed volume, which is closed in the sense that there is substantially no flow into and out of this volume during a single stroke of the piston 9.

The basic operation of the valve is as follows. When the valve is closed, i.e. the head 7 is seated on seat 8, there are two forces acting on the valve. The first of these is the force of the pressure difference between the discharge port 4 and the compression chamber 3 acting on the valve head 7. The second force is provided by the effect of the initial pressures in the first 11 and second 12 chambers. Initially, the pressure in the second chamber 12 is greater than the pressure in the first chamber 11 providing a force which tends to bias the valve element 5 open. However, the pressure in the compression chamber 3 is lower than the pressure in the discharge port 4 by an amount which is sufficient to overcome the biasing force provided by the first 11 and second 12 chambers. The valve element 5 is therefore held shut.

Valve lift is initiated by the rise in pressure in the compression chamber 3 caused by the motion of the reciprocating member 2. In order for the valve to be fully open and hence not restrictive once the delivery pressure is reached, the biasing force provided by the first 11 and second 12 chambers is arranged such that the valve element 5 will start to move with the pressure in the compression chamber 3 typically at 80% of the pressure in discharge port 4.

The pressures in the compression chamber 3 and discharge port 4 do not equalise until a few millimeters of valve lift have been achieved, so that there is still a differential pressure acting on the valve head 7 and influencing its opening up to this point. Above a few millimeters of valve lift, the lift characteristic is dominated by the pressure in the first 11 and second 12 chambers.

The pressure in the first chamber 11 will rise with lift and the pressure in the lower chamber will exhibit only a small drop owing to the presence of the auxiliary chamber 14. The pressure in the first chamber 11 will thus rapidly become higher than the pressure in the lower chamber 12 and this will give rise to a reversal of the force direction acting on the piston 9 which will act to slow the valve and subsequently return it towards its seat. This mechanism is similar to a mass/spring system and the characteristic of the lift will thus be approximately sinusoidal. As a consequence of this there will be no dwell associated with the lift profile.

If the valve element 5 is close to seating when the reciprocating member 2 passes top dead centre, such that there is a restricted flow path past the valve, then the differential pressure acting on the valve head 7 is reversed. This will tend to shut the valve before the flow reversal has allowed a significant volume of gas to escape from the discharge port 4 back into the compression chamber 3.

The structure of the valve assembly is shown in greater detail in FIG. 2, and reference is now made to this figure for description of these further details.

The valve stem 6 passes through the cylinder 10 and is sealed at the top and bottom of this cylinder by carbon filled polymer seals 20. These seals operate without lubrication to avoid the need for a complex oil metering and distribution system.

In order to ensure that the valve stem 6 moves axially, and in order to control bending oscillations which may otherwise occur, one of two different guiding mechanisms may be used. The first of these, as shown on the left hand side of the centre line of FIG. 2 is an annular bearing ring 21 provided around the piston 9. The second mechanism shown on the right hand side of the centre line of FIG. 2 is a bearing guide 22 which surrounds the valve stem 6.

The timing and duration of valve lift is dependent upon the pressures in the first 11 and second 12 chambers. Therefore, in order to control the lift and duration characteristics, ports are provided to vary the pressure in these chambers. It should be noted that this is a passive valve assembly, and therefore the flow through these ports is only sufficient to control the operating points of the valve, rather than to contribute to the actuation of the valve which, as described above, is driven by the rising pressure in the compressor chamber 3. The first chamber 11 is provided with upper port 23 and lower port 24 while the second chamber 12 is fed via a port 25 which leads to the auxiliary chamber 14 (as shown in FIG. 1). All of these ports 23–25 are connected to a source of pressurised gas, and the flow through the ports is controlled by suitable valves.

Although upper 23 and lower 24 ports are illustrated in FIG. 2, it is possible to use either of these ports alone. The upper port 23 has an orifice which is small enough to prevent excessive flow out of the first chamber 11 during compression, but which is large enough that sufficient flow can be supplied between valve actuations to allow the initial pressure in the first chamber 11 to be changed over a small number of cycles. For the lower port 24, the flow is controlled by the position of the piston 9. Thus, when the valve element 6 is seated, the port 24 is partially uncovered allowing the initial pressure in the first chamber 11 to be varied. When the piston rises the port 24 is covered, thereby preventing air from flowing out of the first chamber 11 when the piston moves.

A pair of pressure transducers 26, 27 are provided to measure the pressures in the first 11 and second 12 chambers respectively. These may be used for monitoring and/or controlling the operation of the valve.

Figure 3:
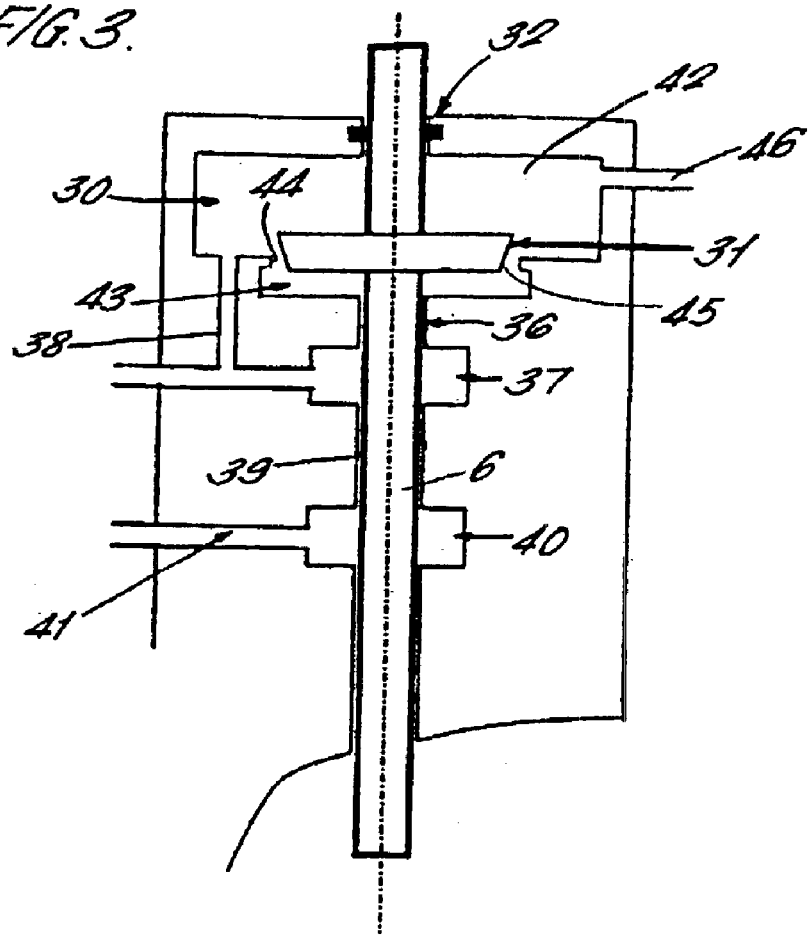
FIG. 3 is a schematic representation of the damping mechanism.

The arrangement for damping the valve element 6 as it moves towards its closed position will now be described with reference to FIGS. 2 and 3.

The damping mechanism consists of a damping chamber 30 which is filled with oil. The valve stem 6 passes through the damping chamber 30, and is provided at this position with a disk shape damping element 31 which is reciprocably movable within the damping chamber 30. The portion of the valve stem 6 passing through the damping chamber 30 has a constant diameter which eliminates pressure changes in the damper oil and eliminates the need for an accumulator. In order to prevent leakage of oil around the valve stem 6 into the second chamber 12, an oil seal ring pair 32 surrounds the valve stem 6 above the damping chamber 30. Any oil which passes the seal is collected in a leak off gallery 33 in an oil plate 34 which is vented along a duct 35. This gallery 33 is also used to collect air from the lower chamber 12 which has passed the seals 20. The duct 35 is vented to a collection tank at atmospheric pressure which ensures that the air pressure in the gallery is lower than the oil pressure in the damper, thus preventing admission of air into the damper.

At the lower end of the damping chamber, no seal is provided. Instead, a small clearance 36 is provided between the valve stem 6 and the surrounding housing. This clearance 36 leads to an oil leak off gallery 37 at $6\times10^5$ Pa which collects the oil which leaks through the small clearance. The clearance is very small in relation to the area of the damping element 31 and does not significantly reduce the damping effect. The small clearance 36 eliminates the need for a high pressure seal which is advantageous as the oil can reach high pressures in the damping chamber 30. The oil from the leak off gallery is mixed with the incoming oil in oil supply line 38.

Below the oil leak off gallery is a second small clearance 39 around the valve stem 6 leading to an air and oil leak off gallery 40 at atmospheric pressure. This gallery 40 collects oil leakage from the oil leak off gallery 37 and also collects air leakage passing up the valve stem 6 from the discharge port 4. This arrangement serves to prevent air from the discharge port 4 from entering the damping oil. The oil which leaks into the air and oil leak off gallery 40 is removed along air and oil discharge line 41 (for convenience, this has been shown in the plane of the section at FIG. 2, but, in practice will extend perpendicular to this plane so as to be spaced from other ports). The oil is collected for reuse.

The damping chamber 30 is essentially divided into two chambers, namely a low pressure chamber 42 generally above the damping element 31 and a high pressure chamber 43 generally below the damping element 31. The high pressure chamber 43 may reach pressures of $2\times10^7$ Pa. The wall of the damping chamber is profiled such that the low pressure chamber 42 has a diameter which is considerably larger than the diameter of the damping element 31, while the high pressure chamber 43 has a diameter which is similar to that of the damping element 31. A lip 44 projects inwardly around the upper edge of the high pressure chamber 43. This cooperates with a downwardly tapering surface 45 on the outer peripheral surface of the damping member 31 as will be described.

Oil enters the damping chamber 30 along oil supply line 38 at the lowermost edge of the low pressure chamber 42 and leaves along oil discharge line 46 at the uppermost level of the low pressure chamber 42. Should any air enter the damping chamber 30, this arrangement ensures that it will be rapidly expelled and will not enter the high pressure chamber 43.

It has been found that upon closing the valve, damping is only required for about the last 2 mm of travel before the valve head 7 is seated and the high pressure chamber 43 is designed accordingly to provide a damping zone only for this portion of valve travel. As the valve opens from its seated position, this damping zone has little influence as the opening velocity is much lower than its closing velocity. Outside the damping zone, the damping element 31 moves within the low pressure chamber 42 and again little damping effect is produced owing to the large clearance around the edge of the damping element 31 in the low pressure chamber 42.

The damping effect only becomes significant as the damping element 31 approaches the high pressure chamber 43 on its downstroke. The tapering surface 45 of the damping element 31 cooperates with the lip 44 to cause the flow through this gap to be similar to the flow through an orifice.

This means that the flow is highly turbulent and, as a consequence, the pressure drop is not affected by oil viscosity. The viscosity is directly affected by the oil temperature, so this feature means that the damping characteristics will not be affected by temperature variations, occurring as the oil warms up during operation.

A further function of the tapering surface 45 of the damping element 31 is that the area between the tapering surface 45 and the lip 44 is gradually reduced during the damping process. As the damping process begins in earnest, the velocity of the damping element will be high and will quickly reduce. The combination of the reducing area and reducing velocity will provide a fairly constant pressure drop across the gap between the tapering surface 45 and lip 44. This provides a constant damping force which will be much lower than would be obtained with a fixed gap.

Figure 4:
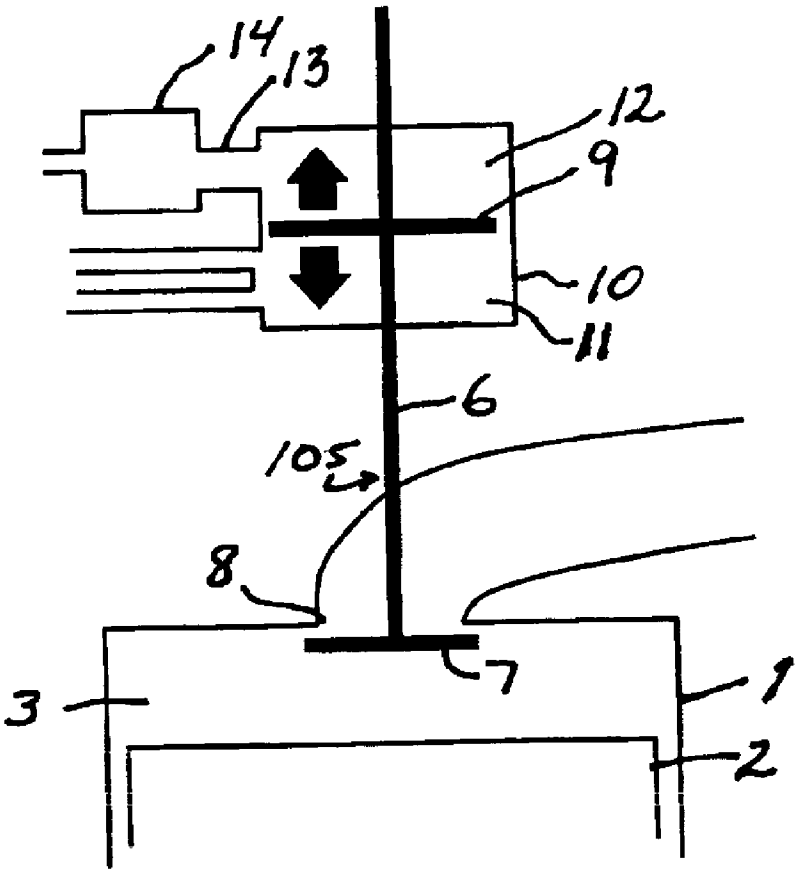
FIG. 4 is a schematic diagram showing the basic elements of the invention as an inlet valve instead of an exhaust valve.

Although the valve has been described as a discharge valve 5, it can also be an inlet valve 105. In this case, the valve element would be arranged to open towards the reciprocating member 3, and the entire assembly within the cylinder 10 including the damping mechanism would be mounted the opposite way up to that illustrated in FIG. 2, as illustrated in FIG. 4 where like elements are provided like numerals.

What is claimed is:

1. A passive valve assembly for controlling flow into or out of a first cylinder in which a member is reciprocable, the assembly comprising a valve element having a head at one end which seats in a port in the first cylinder and is arranged to open in the direction of flow through the port and a piston which is reciprocable in a further cylinder, the side of the piston which faces in the direction of opening defining with the further cylinder a first chamber which is filled with gas such that upon opening of the valve element the gas is compressed in the first chamber, the energy of compression being recovered to close the valve element.

2. An assembly according to claim 1, wherein the piston and further cylinder define a second chamber on the opposite side of the piston to the first chamber, the second chamber being filled with gas, such that upon closing of the valve element the gas is compressed in the second chamber.

3. An assembly according to claim 2, wherein the second chamber is in fluid communication with an auxiliary chamber, the second chamber and auxiliary chamber providing a closed volume.

4. An assembly according to claim 2 or claim 3, wherein the net force on the piston caused by the gas in the first and second chambers is such that, when the valve is seated, the piston is biased in a direction to open the valve.

5. An assembly according to one of claims 1–3, wherein a damping mechanism is provided to dampen the motion of the valve towards its seat and/or to dampen the motion of the valve away from its seat.

6. An assembly according to claim 5, wherein the damping mechanism comprises a disk on the valve element separate from the piston and having a smaller diameter than that of the piston, and a complimentary counterbore in the wall of the second chamber, such that the disk reciprocates within the counterbore for a part of the stroke to provide damping.

7. An assembly according to claim 5, wherein the damping mechanism comprises a disk provided on the valve element so as to be reciprocable in a damping chamber which is separate from the second chamber, the damping chamber being filled with a gas or liquid.

8. An assembly according to claim 7, wherein the diameter of the damping chamber is significantly larger than the diameter of the disk for the majority of the stroke of the disk, but approaches the diameter of the disk for the proportion of the stroke approaching the closed position of the valve.

9. An assembly according to claim 8, wherein the disk is inwardly tapered in the direction in which the valve moves on closing.

10. An assembly according to claim 5, wherein the damping mechanism is a squeeze film damper mechanism comprising a surface which is movable with the piston and which approaches a mating surface which is stationary with respect to the piston such that a thin film of gas is squeezed between the two surfaces at high velocity out of a gap between the two surfaces as the valve head approaches its seat.

11. An assembly according to claim 10, wherein means are provided to vary the pressure in the first chamber over a number of strokes.

12. An assembly according to one of claims 1–3, wherein the valve element is a poppet valve.

13. An assembly according to one of claims 1–3, wherein the valve is an inlet valve arranged to open towards the reciprocable member, and wherein the first chamber is on the side of the piston closest to the valve head.

14. An assembly according to any one of claim 1, 2 or 3, wherein the valve is an outlet valve arranged to open away from the reciprocable member, and wherein the first chamber is on the side of the piston remote from the valve head.

15. An assembly according to claim 2, wherein means are provided to vary the pressure in the second chamber over a number of strokes.

16. A passive valve assembly for controlling flow into or out of a first cylinder in which a member is reciprocable, the assembly comprising valve element having a head at one end which seats in a port in the first cylinder and is arranged to open in the direction of flow through the port, the valve element being biased such that when it is seated, and disregarding any forces acting on the head, the valve is biased open.

17. An assembly according to claim 16, wherein two opposing biasing forces act on the valve element, a first force tending to bias the valve open being greater than a second force tending to bias the valve closed when the valve is seated.

18. An assembly according to claim 16 or claim 17, wherein the valve element is provided with a piston, and the biasing force is provided by pressurised air acting on at least one side of the piston.

* * * * *